US005363787A

United States Patent [19]

Konopasek et al.

[11] Patent Number: 5,363,787

[45] Date of Patent: Nov. 15, 1994

[54] LIQUID CARGO CONTAINER FOR MARINE TRANSPORT

[76] Inventors: James L. Konopasek, 1800 The Greens Way Apt. 806, Jacksonville Beach, Fla. 32250; Cyrus C. Marshall, Jr., 1200 Oriental Garden Rd., Jacksonville, Fla. 32207

[21] Appl. No.: 84,070

[22] Filed: Jun. 30, 1993

[51] Int. Cl.[5] ..... B63B 25/08

[52] U.S. Cl. ..... 114/74 A; 220/404

[58] Field of Search ..... 114/74 R, 74 T, 74 A; 220/403, 404, 560, 562

[56] References Cited

U.S. PATENT DOCUMENTS

| | | | |
|---|---|---|---|
| 3,010,574 | 11/1961 | Jacobson et al. | 114/74 A |
| 3,272,373 | 9/1966 | Alleaume et al. | 114/74 A |
| 3,779,196 | 12/1973 | Knaus et al. | 114/74 T |
| 4,230,061 | 10/1980 | Roberts et al. | 114/74 A |
| 5,031,558 | 7/1991 | Davis | 114/74 R |
| 5,203,828 | 4/1993 | Strain | 114/74 R |

FOREIGN PATENT DOCUMENTS

| | | | |
|---|---|---|---|
| 1044549 | 9/1983 | U.S.S.R. | 114/74 T |

*Primary Examiner*—Jesus D. Sotelo

[57] ABSTRACT

The invention is a container for liquid product in marine transport situations, the container comprising a resilient or elastomeric membrane positioned within the confines of the marine transport vessel. The containment membrane is composed of a suitable material impermeable and inert to the liquid product, of sufficient strength and thickness to contain the liquid without spillage under stress situations. The membrane is supported within the confines of the marine vessel structure by a system consisting of a liquid jacket, preferably seawater, filled to a hydrostatic level closely approximating that of the contained liquid product and, by a plurality of restraining tie members. The surrounding water jacket immerses the container membrane creating a hydrostatic head of liquid such as to effectively counteract the wall pressure on the interior of the container membrane due to the liquid cargo and, will also cause a slight wall pressure on the membrane exterior so as to cause the restraining tie members to normally act in tensile restraint. The restraining tie members act to resist the dynamic loads on the container body resulting from the floating vessel's motions and accelerations. The restraining tie members are constructed of material(s) so arranged so as to act in tension and; do incorporate a mechanism or material property to cause the tie member to disconnect, separate or yield when reaching a predetermined load so as to; cause the container body to dislocate itself from the floating vessel's interior structure and; that the container membrane will separate from the vessel's structure to the extent necessary without causing failure to the membrane so as to; prevent consequential spillage of the liquid product into the marine environment.

4 Claims, 2 Drawing Sheets

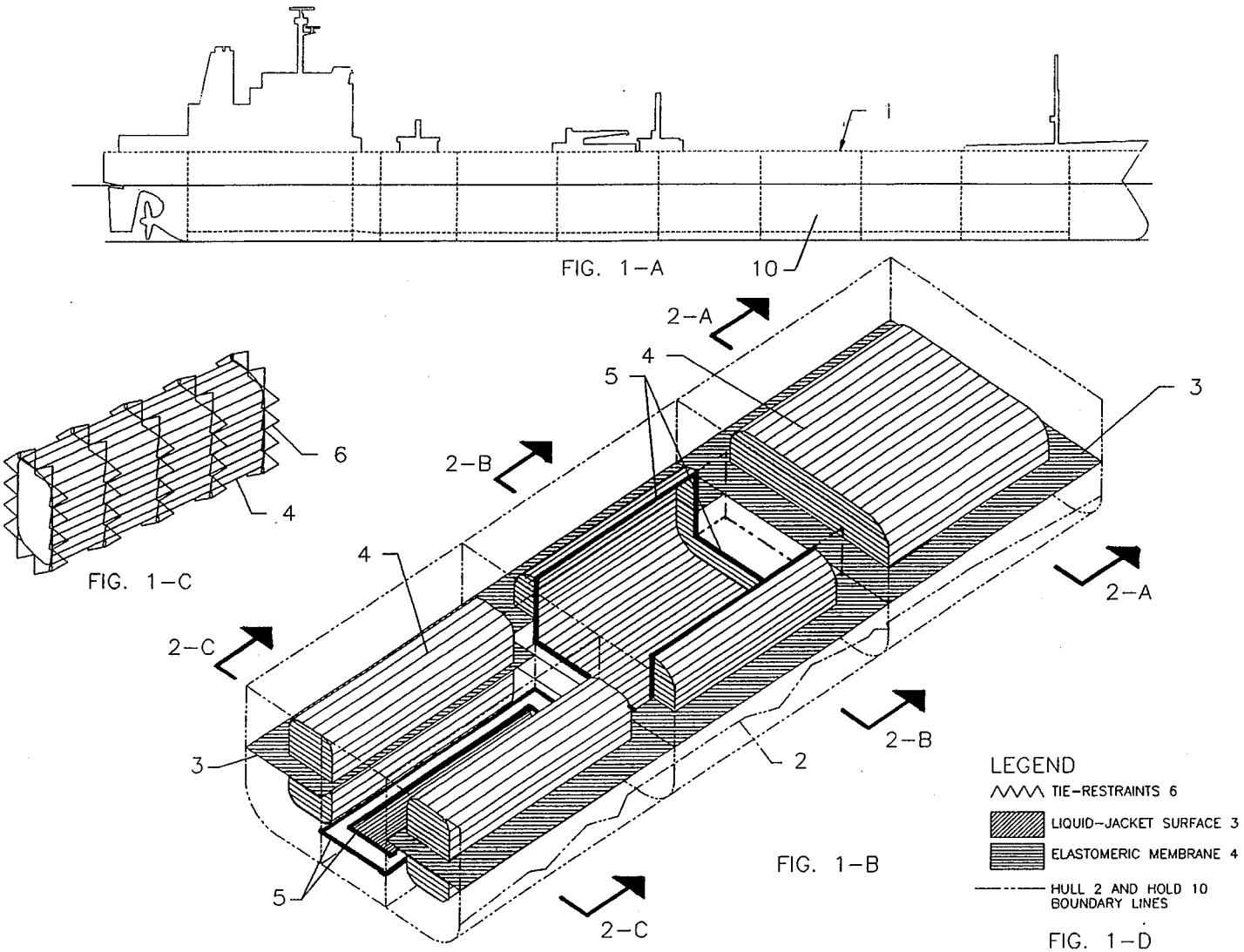
FIG. 1-A
FIG. 1-B
FIG. 1-C
FIG. 1-D

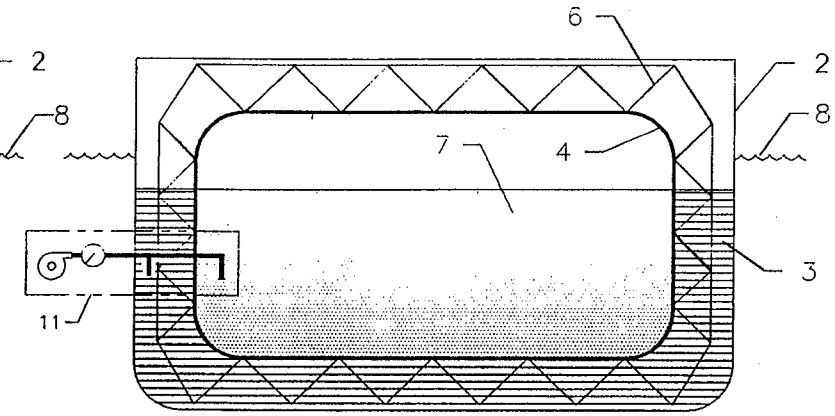
FIG 2-A
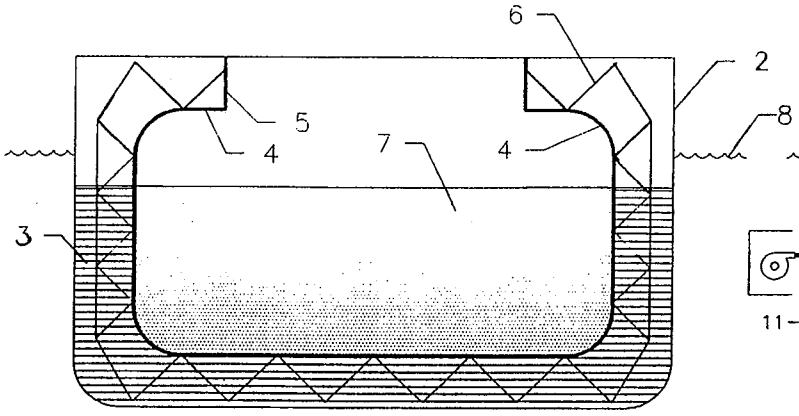
FIG 2-B
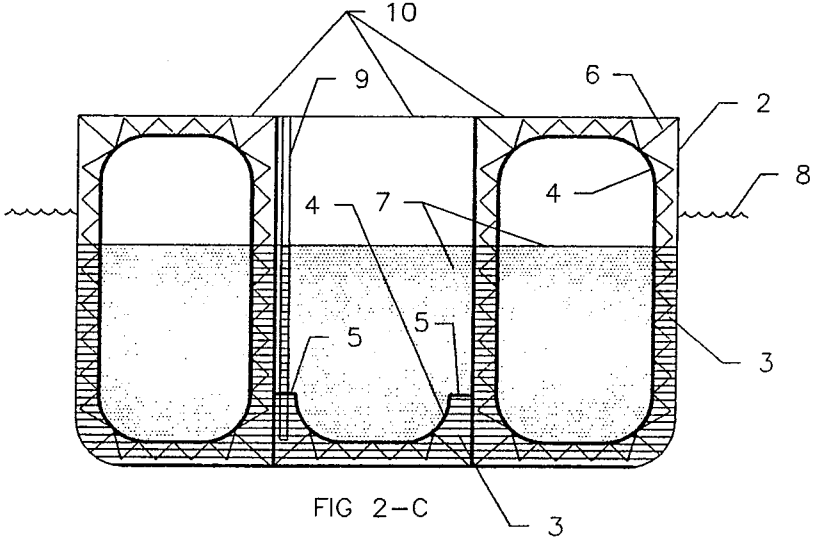
FIG 2-C
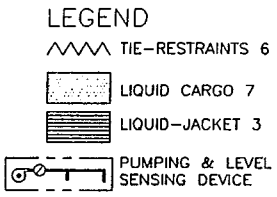
FIG. 2-D

LIQUID CARGO CONTAINER FOR MARINE TRANSPORT

BACKGROUND-FIELD OF INVENTION

This invention relates generally to the containment, or tankage adapted for the marine transport of liquid product. More specifically, the invention relates to the containment of liquid product on marine floating vessels whereby the containment forms an independent interior structure to the marine vessel, positioned such that it is not rigidly fixed to the marine vessel's surrounding structure and that the container consists of an elastomeric type material uniquely supported.

BACKGROUND-DISCUSSION OF PRIOR ART

The marine transport of liquid cargo has traditionally been conveyed by the single-skin tanker ship. The ship's outer skin or hull structure formed the primary containment boundary and as demonstrated by numerous incident, is subject to damage by various causes resulting in breach of the containment and the loss or spill of cargo, causing an environmental intrusion of global concern. In reaction to such incidents, various laws and regulations have been enacted and continue to be developed that deal with marine structures involved in the transport of hazardous liquid product. One approach resulting from such laws and regulations involves the double-skin tanker design, whereby a rigid inner watertight skin is integrally affixed to the vessel's primary floating hull structure, forming a void buffer between the inner and outer skins. The liquid product, in the double-skin design, is contained within the inner rigid skin. It is anticipated that most new vessels will follow the double-skin design and that laws and regulations will require existing single-skin vessels to be retrofitted with a comparable arrangement. It is the inventors' opinion that the rigid double-skin design does not present an optimum solution in preventing the spillage of the liquid product into the environment. Since the inner rigid skin is integral to the vessel's structure, the stresses imparted to the outer skin will also transmit to the rigidly affixed inner skin, subjecting the inner skin to potentially similar undesirable structural damage. Furthermore, the double-skin design does not appear to lend itself as a cost-effective solution to retrofitting existing vessels for compliance with regulatory issues.

A preferred system addressing the concerns of hazardous liquid cargo containment in marine transport involves the use of an independent primary container, positioned within the interior hull of the floating vessel. This inner container is composed of a resilient or elastomeric membrane, impermeable and non-reactive to the liquid product and of sufficient strength and thickness,- that when arranged with a unique restraint system (as will be later described as part of the invention) will retain the liquid in the event of fracture or rupture to the floating vessel.

Prior art is known and encompasses several approaches in the use of a membrane container within an outer rigid tank. For example, Roberts et al. in U.S. Pat. No. 4,230,061, Oct. 28, 1980, shows the use of a membrane or bladder which conforms directly to the shape of the ship's hull. Jacobson et al. in U.S. Pat. No. 3,010,574, Nov. 28, 1961, presents the use of a plurality of flexible-walled containers submerged in water within a rigid-walled hold on a ship. Alleaume et al. in U.S. Pat. No. 3,272,373, Sep. 13, 1966, shows tanks having one or more interior membranes positioned within a ship's hold. In one embodiment, the two membranes are separated by a gas or liquid layer.

OBJECTS AND ADVANTAGES

The invention is an improvement on the constructions found in the prior art. Prior art of J. H. Alleaume et al. requires the use of a non-reinforced, double skin membrane incorporating thermal insulating characteristics, while also requiring a homogenous insulating material and inflatable ribs or sealed pressurized chambers as the separator from the vessel's structure. Roberts et al. utilizes a polyester membrane connected and suspended from a neck-like structural fitting at a ship's deck; an inner plate structure, not unlike the contemporary double-skin tanker ship, is also necessary and fitted within the ship, this arrangement requires a fair, smooth support to the elastomeric membrane. The design of Jacobson et al is limited to the use of packaging ammonia nitrate.

It is preferable that the inner container resilient membrane be separated from the rigid floating vessel's structure such that the external forces and stresses imposed on the floating vessel are not directly transmitted to the container membrane. It is preferable to counteract the pressure affect of the liquid product on the container membrane walls and to do so by introducing a liquid jacket of a controlled hydrostatic head, surrounding the container membrane. Finally, it is preferable to restrain the container membrane within the floating vessel's structure in such a manner as to resist the dynamic motions and accelerations of the floating vessel while also demonstrating capabilities of dislocating local to the damaged or breached area of the vessel, to the extent necessary to prevent breaching of the container membrane and thus preserve the liquid product without spillage into the environment.

It is an object of this invention to provide a system to reduce the risk of spillage of hazardous liquid cargo from marine transport vessels in the event of damage to the hull of the vessel.

It is an object of this invention to provide such a system which can be adapted to and utilized to existing vessels as well as in vessels to be constructed.

It is an object of this invention to provide a container for marine transport of liquid products capable of retaining the liquid cargo intact in the event of rupture to the hull of the marine vessel, the container comprising a resilient, elastomeric membrane positioned within the rigid interior of a hold on a marine vessel, the membrane being separated from the marine vessel structure and supported by a surrounding water jacket and, by a plurality of restraining ties which are adapted to disconnect or rupture under a predetermined stress.

DESCRIPTIONS OF THE DRAWINGS (Sheets 1 and 2)

FIG. 1-A of drawing sheet 1 is an illustration of a typical marine vessel for transporting liquid cargo and illustrates its numerous holds, or cargo divisions. FIG. 1-B is a partial perspective view of a marine vessel revealing three holds, each representing examples of the various approaches that might be adapted to the numerous configurations found in marine vessels. FIG. 1-C is an isolated perspective view of a tank membrane showing an example of tie restraint positioning. FIGS. 2-A, 2-B and 2-C of drawing sheet 2 are cross sectional views from FIG. 1-A and further delineate the various aspects of the invention. FIGS. 1-D and 2-D are legends for clarifying distinct materials and structures.

DETAILED DESCRIPTION OF INVENTION

Referring to drawing sheets 1 and 2, a marine vessel 1 for transporting liquid cargo 7, such as oil, petroleum products or chemicals, typically is constructed with one or more holds 10 located within the vessel's hull 2, as shown in FIG. 1-A. Marine vessel 1 may for example, be a ship or a barge. Holds 10 are compartment divisions designed to receive and contain liquid cargo 7 via suitable sensing and pumping means 11, FIG. 2-A. In typical constructions, the hull 2 of the vessel 1 itself forms the primary boundary structure of a hold 10. In the event of catastrophic failure or rupture to hull 2, in existing current constructions, the liquid cargo 7 is lost into the environment, creating pollution and potentially hazardous conditions.

The invention is a container for liquid cargo comprising generally the combination of a rigid-walled hold 10, an impermeable membrane 4, a liquid jacket layer 3 contained within the hold 10 and surrounding and immersing the membrane 4, a system of restraint members 6 connecting the membrane 4 to the hold 10, and sensing and pumping means 11 to monitor and control the levels of the liquid cargo 7 and the liquid jacket 3, such as to maintain approximately equal levels.

A given vessel 1 may have numerous holds 10 of differing configurations. Some may encompass the entire breadth of the vessel 1 as shown in FIGS. 2-A and 2-B, or there may be a plurality of holds 10 for a given cross-section, as shown in FIG. 2-C. The invention is adaptable to most any configuration, with the primary requisite being that the membrane 4 and the liquid jacket 3 are positioned between the liquid cargo 7 and any wall or boundary of a hold 10 which may be adjacent to the outside environment. As seen in FIG. 2-C, where the walls of the hold 10 are interior to the vessel 1 and do not directly separate the liquid cargo 7 from the outside seawater 8, no membrane 4 or liquid water jacket 3 is required. Thus for a given hold 10 configuration,the membrane 4 may form a bottom, a bottom and side walls, or a bottom, side walls and top. Membrane 4 is composed of a suitable material which is non-reactive and impermeable to the liquid cargo 7. The actual material used to form the membrane 4 will vary depending on the particular cargo 7 being transported, and the various materials known within the industry. For every application, the membrane 4 should be flexible or elastomeric so that it can yield to the stresses imposed and react to the direct contact of foreign objects by repositioning itself without rupture. Likewise, the material chosen and the thickness of membrane 4 must impart sufficient strength to retain the liquid cargo 7 without failure. Some examples of possibly suitable membrane 4 material products by trade name are COOLTHANE (Cooley,Inc.), NIPOL (Zeon Chemicals, Inc.) and VIBRATHANE (Uniroyal Chemical Co., Inc.). The overall configuration of the membrane 4 will be such that it corresponds to the configuration of the particular hold 10 in which it is placed and sized such that there will be space for the water jacket 3 between membrane 4 and the walls of the hold 10.

In the case of a membrane 4 which is not a total envelope for the hold 10, that is, where the membrane 4 only forms a bottom or a bottom and side walls, the peripheral edge of the membrane 4 is connected to the walls of the hold 10 by direct continuous connection to a structural flange 5 extending from the hold 10 and by the restraint members 6, as illustrated in FIGS. 2-B and 2-C. In the case represented by FIG. 2-C center hold, the cavity formed below the membrane is pressurized by a standpipe 9, which communicates a hydrostatic head of liquid to the liquid jacket 3 within the cavity. For a membrane 4 which is a full envelope, and for the panel portions of the membrane 4, the membrane 4 is connected to the bottom, side or top of the hold 10 by restraint members 6.

Restraint members 6 act to maintain the membrane 4 in proper position within the hold 10. When there is no liquid cargo 7, the restraint members 6 keep the surface of the membrane 4 from collapsing. They continue to maintain the position of the membrane 4 during loading or unloading operations involving the liquid cargo 7 and liquid jacket 3. The restraint members 6 also act to steady the membrane 4 within the hold 10 by resisting dynamic loads resulting from ship motion and acceleration. Restraint members 6 are constructed such that they will break, release or yield upon attaining a predetermined stress. Restraint members 6 are constructed of a material having a known breaking stress of a suitable value, or they may be constructed with mechanical connectors which are adapted to release upon a predetermined load. In a collision incident, the hull 2 of the vessel 1 may be ruptured, possibly resulting in the twisting, bending or tearing of the hold 10. The colliding object may penetrate into the hold 10. To protect the liquid cargo 7 and maintain it intact within the membrane 4 without loss to the environment, it is necessary that the membrane 4 be able to reposition itself in response to the stresses or intrusion of foreign objects. Therefore, the restraint members 6 must be releasable from the membrane 4. Should the stresses encountered by the membrane 4 exceed the predetermined amount, the restraint member 6 will either break apart, release or yield, thereby allowing the membrane 4 to dislocate, align and or change shape in response to the incurring damage without rupturing. The restraint members 6 do not have to be of sufficient strength to act against the full weight and pressure of the liquid cargo 7. The restraint members 6 cannot be of rigid type structures such as to themselves impart potentially undesirable stresses to the membrane 4. For this reason, the restraint members are designed to respond to tensile stresses only.

The water jacket 3 is necessary for the invention to work, in that it provides a counteracting pressure on the membrane 4 walls by canceling out the liquid cargo 3 interior wall pressure and also provides a slight compressive pressure on the membrane 4 exterior wall against the liquid cargo 3 pressure. This compressive pressure allows the restraint members 6 to be constructed having only the minimal strength necessary to maintain the membrane 4 in position with the help of the water jacket 3. Preferably, the liquid jacket 3 is composed of water, or seawater 8, such that any rupture in the hull 2 will not in itself release harmful materials into the environment. Where the liquid jacket is a water medium compatible to the outside seawater 8, then the seawater is conveniently available for filling or purging of the water jacket 3.

Since the liquid jacket 3 acts against the liquid cargo 7, it is necessary to provide a means to maintain the surface levels of the liquid jacket 3 and the liquid cargo 7 relatively equal during loading and unloading operations. Sensing and pumping means 11 of types well known in the industry, are used to monitor the levels of the two liquids and to maintain the levels in balance. As the liquid cargo 7 is loaded into an empty membrane 4, the sensing and pumping means 11 monitor and raise the level of the liquid jacket 3 to correspond to the raising level of the liquid cargo 7. As the liquid cargo 7 is unloaded, the sensing and pumping means 11 monitor and lower the level of the liquid jacket 3 accordingly. In this manner, the restraints 6 are never unduly placed under excessive load conditions which might otherwise result in the undue release of the membrane 4 from the hold 10.

If the hull 2 of the vessel 1 is ruptured, the outside seawater 8 in which the vessel 1 is floating will either flood into the hold 10 and contribute to the liquid jacket 3 or, some of the liquid jacket 3 will be released to the environment, depending upon the resulting position and trim of the vessel 1 within the seawater 8 after rupture and, depending upon the final repositioning of the membrane 4 within the hold 10. In either scenario, the liquid jacket 3 with the outside seawater 8 will nevertheless effectively provide the necessary compressive pressure against the membrane 4, which will act in conjunction with any unreleased restraint members 6 to maintain the integrity of membrane 4.

We claim:

1. A liquid cargo container for marine transport which consists of a marine transport vessel, a membrane consisting of an elastic synthetic compound impregnated on a reinforcing woven fabric positioned within the marine transport vessel forming an oiltight envelope, a plurality of flexible tensile restrains, each incorporating load sensitive release means, and a bed of water between the ship's structure and membrane, maintained approximately equilevel to the liquid cargo level, comprised of water drawn and disposed of from and to the sea.

2. A liquid cargo container for marine transport as claimed in claim 1 wherein said flexible tensile restraints consist of a woven strand rope including one of nylon and woven fabric strap arranged diagonally in a transverse and longitudinal direction in an array of suitably spaced points on the membrane and attaching to the ship's.

3. A liquid cargo container for marine transport as claimed in claim 1 wherein said load sensitive release means consists of a material capable of disconnecting, breaking or yielding upon attaining a predetermined stress.

4. A liquid cargo container for marine transport as claimed in claim 1 wherein said membrane is so arranged so as to form a partial envelope whereto the marine transport's steel structure attached and forms an integral oiltight boundary.

* * * * *